US011022264B1

(12) United States Patent
Shih et al.

(10) Patent No.: US 11,022,264 B1
(45) Date of Patent: Jun. 1, 2021

(54) HEADLIGHT OPTICAL SYSTEM AND LAMP USING THE SAME

(71) Applicant: AUTOMOTIVE RESEARCH & TESTING CENTER, Changhua County (TW)

(72) Inventors: Chun-Yao Shih, Changhua County (TW); Yi-Cheng Chen, Changhua County (TW)

(73) Assignee: Automotive Research & Testing Center, Changhua County (TW)

( * ) Notice: Subject to any disclaimer, the term of this patent is extended or adjusted under 35 U.S.C. 154(b) by 0 days.

(21) Appl. No.: 17/027,955

(22) Filed: Sep. 22, 2020

(51) Int. Cl.

| | |
|---|---|
| ***F21V 5/04*** | (2006.01) |
| ***F21S 41/143*** | (2018.01) |
| ***F21S 41/25*** | (2018.01) |
| ***F21S 41/20*** | (2018.01) |
| *F21Y 115/10* | (2016.01) |

(52) U.S. Cl.
CPC ..... *F21S 41/143* (2018.01); *F21S 41/25* (2018.01); *F21S 41/285* (2018.01); *F21Y 2115/10* (2016.08)

(58) Field of Classification Search
None
See application file for complete search history.

(56) References Cited

U.S. PATENT DOCUMENTS

2013/0058085 A1* 3/2013 Lee ..... G02B 19/0028 362/245
2015/0003075 A1* 1/2015 Lin ..... F21V 5/04 362/308
2015/0184828 A1* 7/2015 Dai ..... G02B 19/0009 362/311.02
2018/0114788 A1* 4/2018 Ahlers ..... H01L 27/0292

OTHER PUBLICATIONS

Chun-Yao Shih, et al., "Multi-channel LED light source smart headlight optical design," The 22nd National Conference on Vehicle Engineering, National Taipei University of Technology, Taipei, Taiwan, Nov. 24, 2017, A-22.

* cited by examiner

*Primary Examiner* — Elmito Breval
(74) *Attorney, Agent, or Firm* — Rosenberg, Klein & Lee

(57) ABSTRACT

A headlight optical system and a lamp using the same are provided. The headlight optical system is implemented with the refractive optical system of a single lens. The headlight optical system includes a first incident surface, a second incident surface, and an exit surface. The first incident surface is a horizontal plane. The second incident surface surrounds the first incident surface. The inner edge of the second incident surface is connected with the outer edge of the first incident surface. The second incident surface has an inclined angle with respect to the first incident surface. After the light emitted from the polycrystalline light source is incident on the first incident surface or the second incident surface, the refractive optical system refracts and emits the light from the exit surface.

13 Claims, 5 Drawing Sheets

HEADLIGHT OPTICAL SYSTEM AND LAMP USING THE SAME

BACKGROUND OF THE INVENTION

Field of the Invention

The present invention relates to an optical illumination system, particularly to a headlight optical system and a lamp using the same.

Description of the Related Art

In recent years, the development of vehicular systems focuses on safety, performance, and automatic driving assistance. Intelligent headlamps are used as one of the means of communication for advanced driver assistance systems (ADAS). In addition to electronic communication among systems, advanced driving assistance systems can also use intelligent headlamps to provide additional visual assistance, such as warnings and important reminders, as direct and fast communication between vehicles and people. For example, the conventional intelligent headlamps use the optical design with arrayed light-emitting characteristics and control the lighting of each single illumination area to implement and combine multiple small-area illumination unit modules, thereby achieving the warning effect that meets the needs.

For optical design, the sharpness is more required in order to protect from light because the light emitting area of the intelligent headlamp is larger. Thus, compared with the conventional lamp system, the difficulty in designing intelligent headlamps is higher. FIG. 1A is a schematic diagram illustrating an optical route of a single lens 30. As illustrated in FIG. 1A, when a light source emits light into the lens 30 of the intelligent headlamp, the luminous image projected by the lens 30 has astigmatism. For areas having larger magnification and being closer to edges, the effect of image sharpness is more serious. As illustrated in FIG. 1B, if the optical system includes the common lenses forming multiple areas with smaller apertures, the intelligent headlamp requires several auxiliary light-receiving lenses 31 to cooperate with a projection lens set 32. As illustrated in FIG. 1C, the intelligent headlamp narrows the light emitting range of each LED with the first-order optical elements, such as light guide strips 33. Then, a projection lens 34 magnifies and projects an image on the front road. As illustrated in FIG. 1C, the usage of light is reduced since the intelligent headlamp is implemented with multiple optical elements. In the future, the array of LEDs will have higher and higher pixels, and the units will be smaller. Thus, the requirements for sharpness will be increased to avoid mutual interference. However, the conventional intelligent headlamp cannot satisfy the requirement.

To overcome the abovementioned problems, the present invention provides a headlight optical system and a lamp using the same, so as to solve the afore-mentioned problems of the prior art.

SUMMARY OF THE INVENTION

The primary objective of the present invention is to provide a headlight optical system, which includes a single lens with a second incident surface. The second incident surface is an inclined focal plane that can improve the sharpness of the light-source image generated by a light source, thereby projecting and magnifying the luminous image with sufficient sharpness.

Another objective of the present invention is to provide a headlight optical system, which includes a second incident surface surrounding a horizontal first incident surface. The second incident surface is a continuous curved surface. When the peripheral light enters into the optical system, the second incident surface refracts and condenses the light.

Further objective of the present invention is to provide a headlight optical system and a lamp using the same, which generate a luminous pattern with a polycrystalline light source. The headlight optical system provides a wide of variety of uses for intelligent lamps. The headlight optical system cooperates with a single lens to emit brighter light and project clearer luminous images.

In an embodiment of the present invention, a headlight optical system is provided. The headlight optical system is implemented with the refractive optical system of a single lens. The headlight optical system includes a first incident surface, a second incident surface, and an exit surface. The second incident surface surrounds the first incident surface. The inner edge of the second incident surface is connected with the outer edge of the first incident surface. The second incident surface has an inclined angle with respect to the first incident surface. After light emitted from a light source enters the refractive optical system after being retracted by the first incident surface or the second incident surface, the light is refracted by the exit surface and emitted from the exit surface.

In an embodiment of the present invention, he inclined angle is included between the first incident surface and the second incident surface, and the inclined angle has a range of 90~180 degrees.

In an embodiment of the present invention, the first incident surface is a horizontal plane.

In an embodiment of the present invention, the second incident surface is a ring-shaped continuous curved surface.

In an embodiment of the present invention, the second incident surface is an inclined focal plane.

In an embodiment of the present invention, the light source is a polycrystalline light source with light emitting elements.

In an embodiment of the present invention, the light emitting elements comprise one of mini light emitting diodes (LEDs), micro light emitting diodes (LEDs), laser diodes (LDs), or a combination of these.

In an embodiment of the present invention, lamp using a headlight optical system is provided. The lamp includes a polycrystalline light source with light emitting elements and the refractive optical system of a single lens. The refractive optical system includes a first incident surface, a second incident surface, and an exit surface. The second incident surface surrounds the first incident surface. The inner edge of the second incident surface is connected with the outer edge of the first incident surface. The second incident surface has an inclined angle with respect to the first incident surface. After light emitted from the polycrystalline light source enters the refractive optical system after being retracted by the first incident surface or the second incident surface, the light is refracted by the exit surface and emitted the light from the exit surface.

Below, the embodiments are described in detail in cooperation with the drawings to make easily understood the technical contents, characteristics and accomplishments of the present invention.

DETAILED DESCRIPTION OF THE INVENTION

Figure 1B:
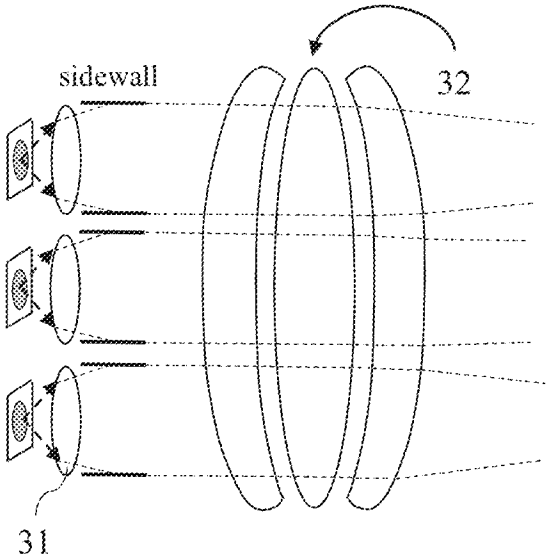
Fig. 1B (prior art)
FIGS. 1A-1C are schematic diagrams illustrating optical systems of vehicular intelligent lamps in the conventional technology.
Figure 1C:
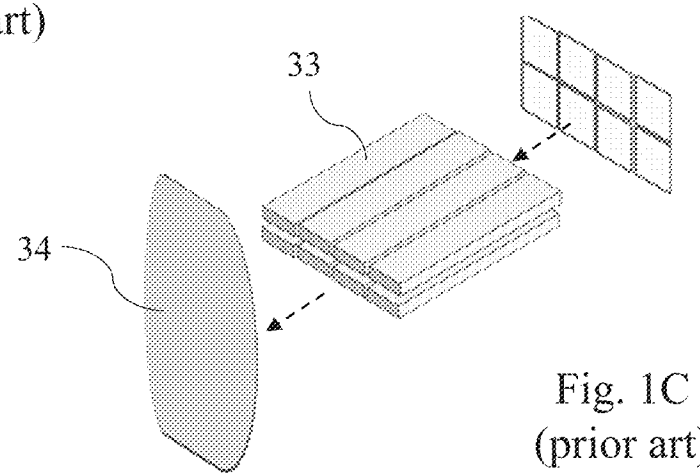
Fig. 1C (prior art)
Figure 1A:
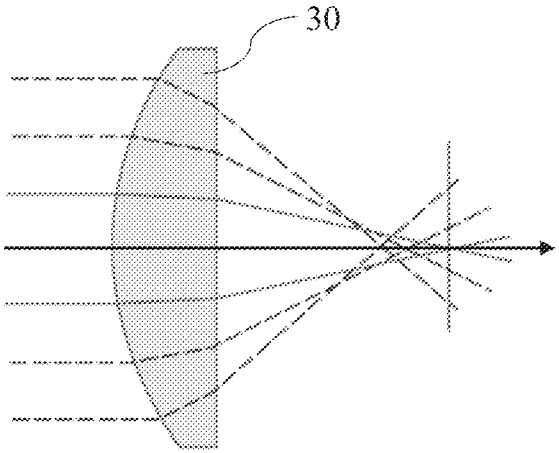
Fig. 1A (prior art)

Reference will now be made in detail to embodiments illustrated in the accompanying drawings. Wherever possible, the same reference numbers are used in the drawings and the description to refer to the same or like parts. In the drawings, the shape and thickness may be exaggerated for clarity and convenience. This description will be directed in particular to elements forming part of, or cooperating more directly with, methods and apparatus in accordance with the present disclosure. It is to be understood that elements not specifically shown or described may take various forms well known to those skilled in the art. Many alternatives and modifications will be apparent to those skilled in the art, once informed by the present disclosure.

Unless otherwise specified, some conditional sentences or words, such as "can", "could", "might", or "may", usually attempt to express that the embodiment in the present invention has, but it can also be interpreted as a feature, element, or step that may not be needed. In other embodiments, these features, elements, or steps may not be required.

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The phrases "be coupled to," "couples to," and "coupling to" are intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

In an embodiment of the present invention, a headlight optical system and a lamp using the same are provided. The present invention uses a polycrystalline lighting emitting diode (LED) as a light source. The polycrystalline LED has a plurality of lighting emitting crystal grains. Thus, in order to protect from light, the lighting of each lighting emitting crystal grain can be independently controlled to form different bright areas and dark areas. The area of the polycrystalline LED is larger than that of the common LED. The polycrystalline LED is designed based on the individual light emitting surface rather than the overall light emitting surface. The light emitted from the polycrystalline LED passes through the optical system to form an image. In addition to considering the brightness and light pattern, the image also has requirements for sharpness. In order to obtain the high usage of light, the optical system is designed based on a single lens. The common optical system is implemented with a spherical lens whose focal plane is curved. The curved focal plane will cause the edge of the light source to be out of focus and cause other problems, such as blurring and unequally magnifying luminous images. Thus, the edge area is more likely to interfere with other surrounding dark areas. In order to solve the abovementioned problems, the present invention designs a single lens to have an inclined focal plane, thereby improving the sharpness of luminous images.

Figure 2:
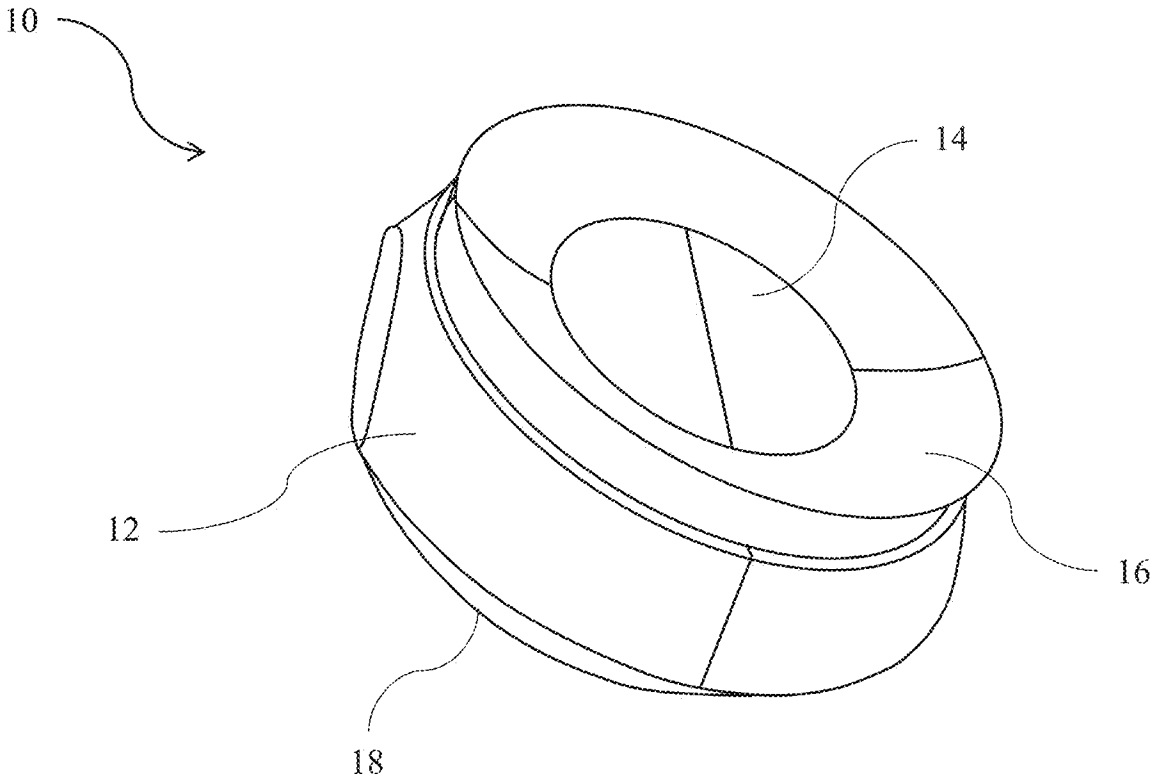
FIG. 2 is a schematic diagram illustrating a headlight optical system arranged at an angle according to an embodiment of the present invention.
Figure 3:
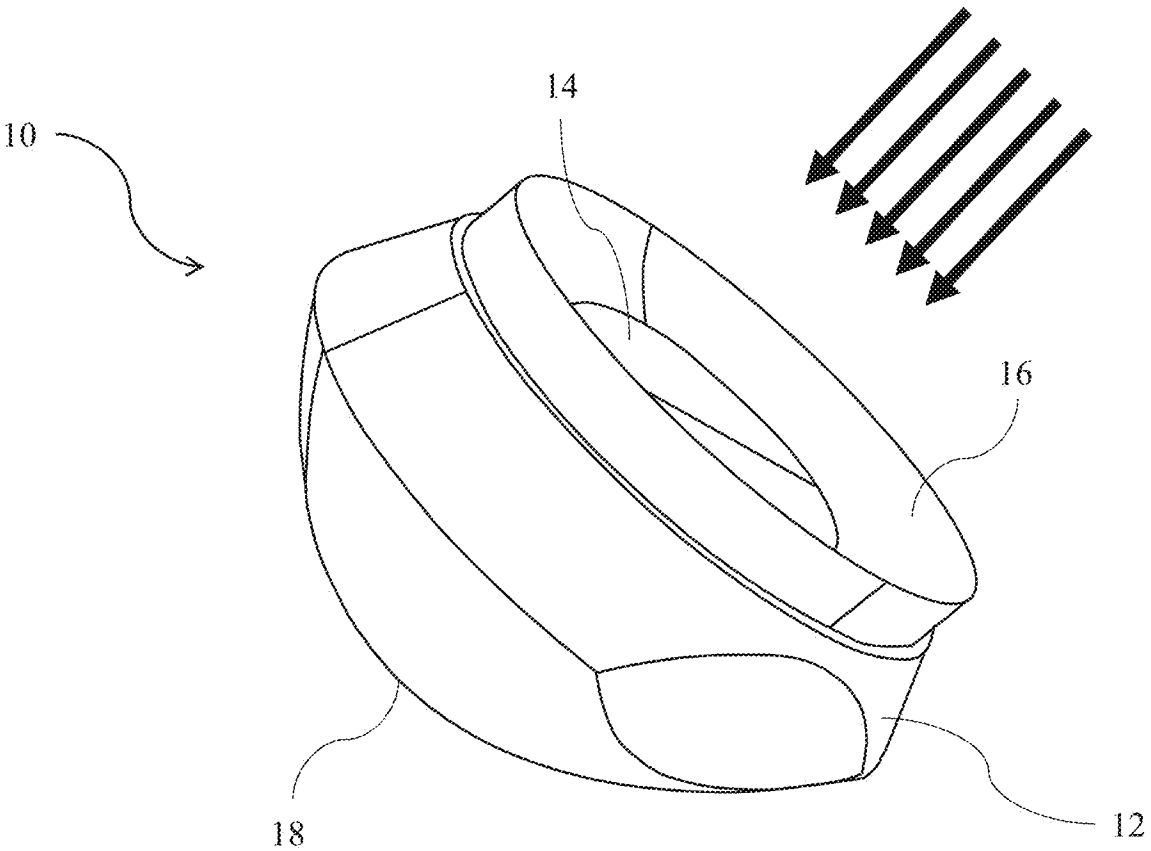
FIG. 3 is a schematic diagram illustrating a headlight optical system arranged at another angle according to an embodiment of the present invention.
Figure 4:
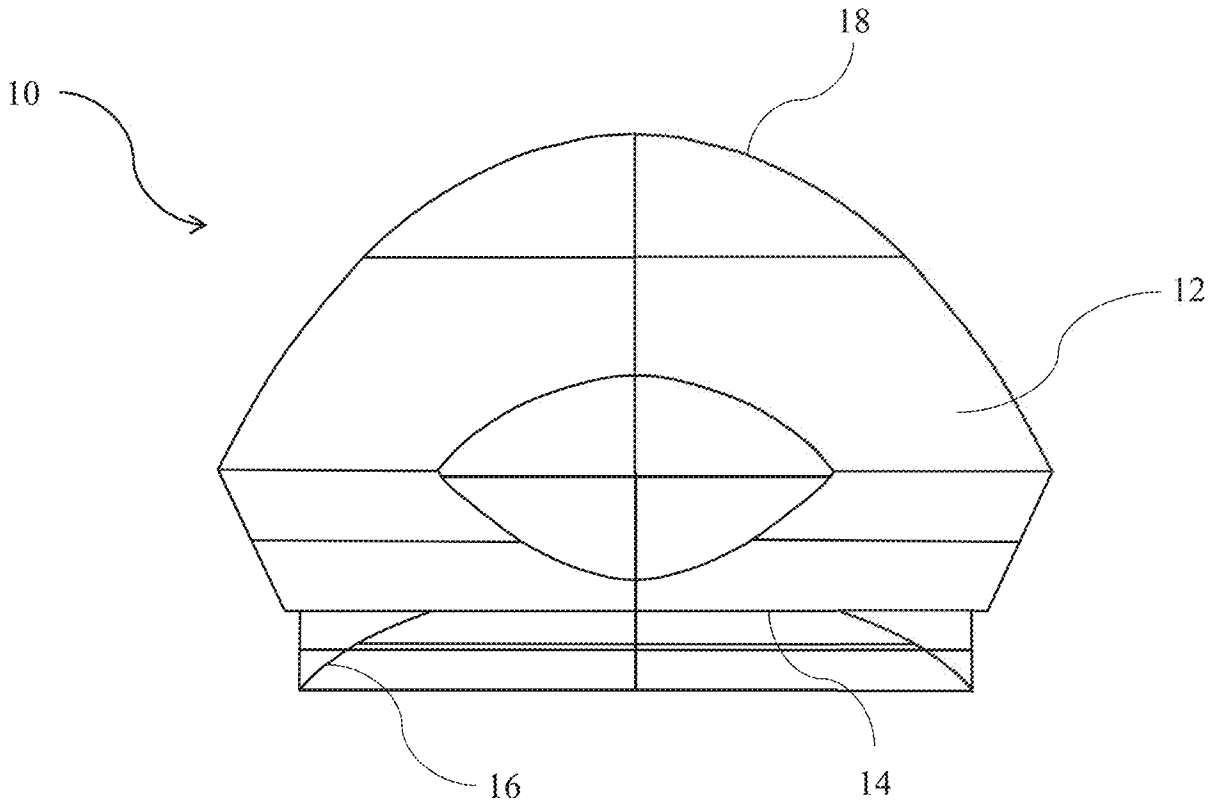
FIG. 4 is a side view of a headlight optical system according to an embodiment of the present invention.

FIG. 2 is a schematic diagram illustrating a headlight optical system arranged at an angle according to an embodiment of the present invention. FIG. 3 is a schematic diagram illustrating a headlight optical system arranged at another angle according to an embodiment of the present invention. FIG. 4 is a side view of a headlight optical system according to an embodiment of the present invention.

Referring to FIG. 2, FIG. 3, and FIG. 4, a headlight optical system 10 is provided according to an embodiment of the present invention. The headlight optical system 10 is implemented with the refractive optical system 12 of a single lens. The lens may be any lens. The optical system 12 includes a first incident surface 14, a second incident surface 16, and an exit surface 18. The first incident surface 14 is a horizontal plane. The second incident surface 16 may be a ring-shaped continuous curved surface. The second incident surface 16 surrounds the first incident surface 14. The inner edge of the second incident surface 16 is connected with the outer edge of the first incident surface 14. The second incident surface 16 has an inclined angle with respect to the first incident surface 14. The light emitted from a light source is retracted by the first incident surface 14 or the second incident surface 16 and enters the refractive optical system 12. After passing through the optical system 12, the light is refracted by the exit surface 18 and then exits from the exit surface 18. In an embodiment, the first incident surface 14 and the second incident surface 16 receive and collimate the light emitted from the light source. The exit surface 18 has the function of redirecting and collimated light to satisfy requirements for luminous images and its illumination properties.

In particular, the second incident surface 16 may be curved. In general, the curved focal plane can cause the edge of the light source to be out of focus and cause other problems, such as blurring and unequally magnifying the luminous image. In order to solve the problems, the curved second incident surface 16 may be an inclined focal plane having an inclined angle. This way, the light will be incident obliquely to mitigate the adverse optical influences. That is to say, the second incident surface 16 can condense the light to increase the usage of light and imaging sharpness. In an embodiment, the inclined angle of the inclined focal plane is included between the first incident surface 14 and the second incident surface 16. The inclined angle has a range of 90~180 degrees.

Figure 5B:
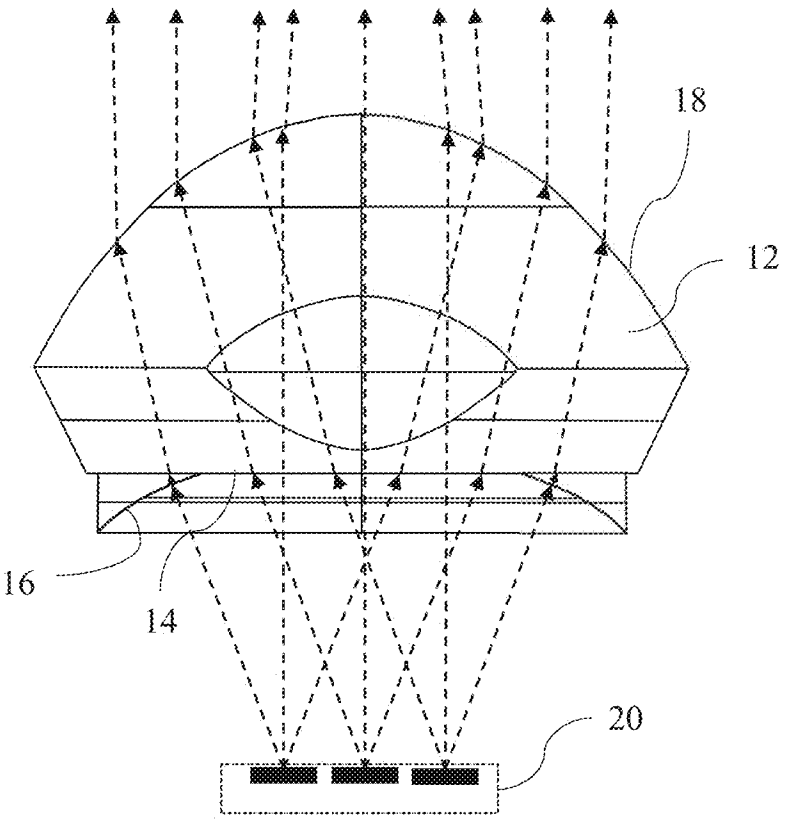
FIG. 5B is a schematic diagram illustrating an optical route of a headlight optical system according to an embodiment of the present invention.
Figure 5A:
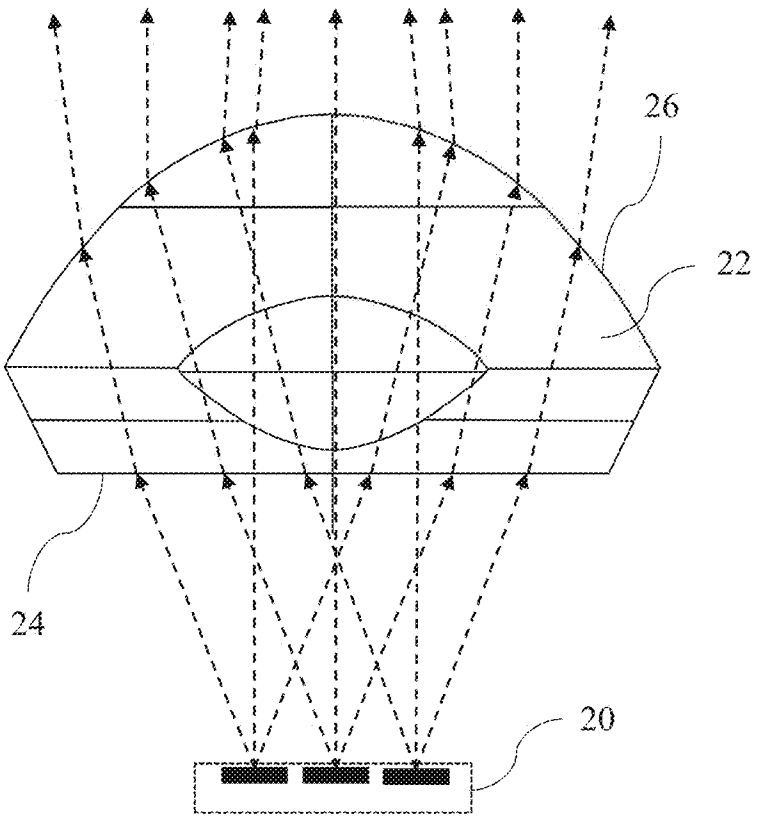
Fig. 5A (prior art)
FIG. 5A is a schematic diagram illustrating an optical route of a lens without a second incident surface in the conventional technology.

Comparing FIG. 5A with FIG. 5B, it is obviously observed that the second incident surface 16 can condense the light in the optical system of a single lens. FIG. 5A is a schematic diagram illustrating an optical route of a lens without the second incident surface. The optical system 22 of a single lens only includes one incident surface 24. After the light emitted from the light source 20 is refracted by the incident surface 24, the light enters into the optical system 22. The light, refracted by the exit surface 26, exits from the exit surface 26. FIG. 5B is a schematic diagram illustrating an optical route of a headlight optical system according to an embodiment of the present invention. Referring to FIG. 5B, after the light emitted from the light source 20 is refracted by the first incident surface 14 or the second incident surface 16, the light enters into the optical system 12. The light, refracted by the exit surface 18, exits from the exit surface 18. It is obviously observed that the optical routes passing through the middle of the first incident surface 14 in FIG. 5B are the same to the optical routes passing through the middle of the incident surface 24 in FIG. 5A when using the same light source 20. However, the peripheral incident light has different optical routes after exiting from the optical system because of the second incident surface 16 of the embodiment. Specifically, the peripheral light passing through the second incident surface 16 in FIG. 5B has convergent optical routes. The peripheral light passing through the incident surface 24 in FIG. 5A has divergent optical routes.

In another embodiment, a lamp using the headlight optical system is provided. The lamp includes a polycrystalline light source 20 and the optical system 12. Referring to FIG. 5B, the polycrystalline light source 20 is an arrayed light source with light emitting elements. The polycrystalline light source 20 is configured to emit light and generate a light-source image. The light emitting elements include one of mini light emitting diodes (LEDs), micro light emitting diodes (LEDs), laser diodes (LDs), or a combination of these. After the light emitted from the polycrystalline light source 20 is refracted by the first incident surface 14 or the second incident surface 16, the light enters into the optical system 12. The light, refracted by the exit surface 18, exits from the exit surface 18 and provides illumination for a vehicle.

The headlight optical lens of the present invention features better sharpness and concentrated brightness. Accordingly, the headlight optical lens is applied to the front intelligent lamp of a vehicle, such that the front intelligent lamp of the vehicle has wider applications. For example, the headlight optical lens of the present invention is used for warning at night. When a vehicle drives at night, the vehicular image module obtains the information on front road conditions to determine whether pedestrians, pedestrian-like, or vehicles approach in the front. When the system determines pedestrians, pedestrian-like, or vehicles approach in the front, the system switches the front intelligent lamp to spotlight mode, thereby irradiating the front passersby and warning the front passersby that vehicles approach. In another embodiment, an arrayed light source is alternatively used as the light source for the headlight optical lens for warning purposes. The design has arrayed light-emitting characteristics and controls the lighting of each single illumination area to implement and combine multiple small-area illumination unit modules, thereby achieving the warning effect that meets the needs. For example, when the arrayed light source fully illumes, the lamp operates in spotlight mode. When a left column of the arrayed light source illumes, the lamp represents a left-turn warning. When a right column of the arrayed light source illumes, the lamp represents a right-turn warning. The combined lighting effect requires higher sharpness, such that a clear luminous pattern is formed after the light passes through the optical system. The headlight optical system of the present invention can focus the light and concentrate the brightness, such that the edge image of the pattern is clear. As a result, the present invention does not blur the pattern boundary due to the divergence of light. Then, the luminous pattern can achieve the warning effect that meets the needs.

According to the embodiments provided above, the headlight optical system of the present invention includes the polycrystalline light source that superimposes the luminosity of multiple illumination surfaces and produces the brightness required for different illumination ranges and sharpness of spotlights, warning lights, etc. On top of that, the present invention uses the second incident surface of the inclined focal plane to mitigate the adverse optical influence caused by the curved focal plane and further corrects the aberration, so that the light pattern of each area of the luminous image is not affected. This way, the brightness can be concentrated such that the dark areas are darker. Therefore, the usage of light increases and the luminous image becomes clearer. The present invention is very suitable for lamps, especially headlamps of vehicles. Since the single lens used in the headlight optical system of the present invention has less deformation structure, the manufacturing cost of the single lens is lower than that of the aspheric surface and other deformation structures. In addition, the present invention only uses a single lens. In other words, the present invention does not require additional optical elements, such as light guide strips and lens sets. Thus, the overall size of the lamp is small such that the lamp has higher variability.

The embodiments described above are only to exemplify the present invention but not to limit the scope of the present invention. Therefore, any equivalent modification or variation according to the shapes, structures, features, or spirit disclosed by the present invention is to be also included within the scope of the present invention.

What is claimed is:

1. A headlight optical system, implemented with a refractive optical system of a single lens, comprising:

a first incident surface;

a second incident surface surrounding the first incident surface, wherein an inner edge of the second incident surface is connected with an outer edge of the first incident surface, and the second incident surface has an inclined angle with respect to the first incident surface; and an exit surface, wherein light emitted from a light source enters the refractive optical system after being retracted by the first incident surface or the second incident surface, then the light is refracted by the exit surface and emitted from the exit surface.

2. The headlight optical system of claim 1, wherein the inclined angle is included between the first incident surface and the second incident surface, and the inclined angle has a range of 90~180 degrees.

3. The headlight optical system of claim 1, wherein the first incident surface is a horizontal plane.

4. The headlight optical system of claim 1, wherein the second incident surface is a ring-shaped continuous curved surface.

5. The headlight optical system of claim 1, wherein the second incident surface is an inclined plane.

6. The headlight optical system of claim 1, wherein the light source is a polycrystalline light source with light emitting elements.

7. The headlight optical system of claim 6, wherein the light emitting elements comprise one of mini light emitting diodes (LEDs), micro light emitting diodes (LEDs), laser diodes (LDs), or a combination of these.

8. A lamp using a headlight optical system and comprising:

a polycrystalline light source with light emitting elements configured to emit light; and a refractive optical system of a single lens comprising:

a first incident surface;

a second incident surface surrounding the first incident surface, wherein an inner edge of the second incident surface is connected with an outer edge of the first incident surface, and the second incident surface has an inclined angle with respect to the first incident surface; and an exit surface, wherein the light emitted from the polycrystalline light source enters the refractive optical system after being retracted by the first incident surface or the second incident surface, then the light is refracted by the exit surface and emitted from the exit surface.

9. The lamp using a headlight optical system of claim 8, wherein the inclined angle is included between the first incident surface and the second incident surface, and the inclined angle has a range of 90~180 degrees.

10. The lamp using a headlight optical system of claim 8, wherein the first incident surface is a horizontal plane.

11. The lamp using a headlight optical system of claim 8, wherein the second incident surface is a ring-shaped continuous curved surface.

12. The lamp using a headlight optical system of claim 8, wherein the second incident surface is an inclined plane.

13. The lamp using a headlight optical system of claim 8, wherein the light emitting elements comprise one of mini light emitting diodes (LEDs), micro light emitting diodes (LEDs), laser diodes (LDs), or a combination of these.

* * * * *